US007557789B2

(12) United States Patent
Rosenquist

(10) Patent No.: US 7,557,789 B2
(45) Date of Patent: Jul. 7, 2009

(54) DATA-DEPENDENT, LOGIC-LEVEL DRIVE SCHEME FOR DRIVING LCD PANELS

(75) Inventor: Russell M. Rosenquist, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 841 days.

(21) Appl. No.: 11/124,838

(22) Filed: May 9, 2005

(65) Prior Publication Data

US 2006/0250324 A1 Nov. 9, 2006

(51) Int. Cl.
*G09G 3/36* (2006.01)

(52) U.S. Cl. ..... 345/96; 345/87; 345/89; 345/98; 345/100

(58) Field of Classification Search ..... 345/34, 345/81, 87, 89, 96–100, 107, 147, 204, 208, 345/210, 589, 691; 358/1.8, 1.6; 347/142; 349/81

See application file for complete search history.

(56) References Cited

U.S. PATENT DOCUMENTS 4,547,043 A * 10/1985 Penz ..... 349/81
4,823,284 A * 4/1989 Ward ..... 358/1.8
4,834,504 A * 5/1989 Garner ..... 345/87
5,739,803 A * 4/1998 Neugebauer ..... 345/98
5,852,429 A * 12/1998 Scheffer et al. ..... 345/100
5,910,793 A * 6/1999 Rogovin et al. ..... 345/100
6,005,558 A * 12/1999 Hudson et al. ..... 345/204
6,057,821 A * 5/2000 Hughes et al. ..... 345/97
6,108,122 A 8/2000 Ulrich et al.
6,111,676 A * 8/2000 Lemus et al. ..... 398/1
6,151,011 A * 11/2000 Worley et al. ..... 345/692
6,211,851 B1 * 4/2001 Lien et al. ..... 345/89
6,239,889 B1 * 5/2001 Harley et al. ..... 398/9
6,326,980 B1 * 12/2001 Worley, III ..... 345/691
6,339,413 B1 * 1/2002 Drake et al. ..... 345/50
6,407,727 B1 6/2002 Pangger
6,535,195 B1 * 3/2003 Nelson ..... 345/102
6,646,638 B1 * 11/2003 Yeung et al. ..... 345/214
6,683,587 B2 * 1/2004 Gulsen ..... 345/38
6,989,824 B1 * 1/2006 Ishii et al. ..... 345/204
2002/0101433 A1 * 8/2002 McKnight ..... 345/589
2003/0103046 A1 * 6/2003 Rogers et al. ..... 345/204
2003/0193491 A1 * 10/2003 Lawrence et al. ..... 345/204
2004/0174328 A1 * 9/2004 Hudson ..... 345/87
2005/0024391 A1 2/2005 Damer-Venkata et al.
2005/0134530 A1 * 6/2005 Khurana et al. ..... 345/50
2006/0012594 A1 * 1/2006 Worley et al. ..... 345/204
2006/0109226 A1 * 5/2006 Tyrrell et al. ..... 345/98
2006/0284902 A1 * 12/2006 Ng ..... 345/691

* cited by examiner

*Primary Examiner*—Prabodh M. Dharia
(74) *Attorney, Agent, or Firm*—Mima G. Abyad; Wade J. Brady, III; Frederick J. Telecky, Jr.

(57) ABSTRACT

System and method for driving an LCD using a data-dependent, logic-level drive scheme. A preferred embodiment comprises determining a desired state of each pixel in an LCD pixel segment, deriving a drive waveform based upon the state of all pixels in the LCD pixel segment, and outputting the drive waveform to the LCD pixel segment. By using the states of all the pixels in the LCD pixel segment in the determination of the drive waveform, it is possible to increase the on and off voltage to help improve display quality.

23 Claims, 8 Drawing Sheets

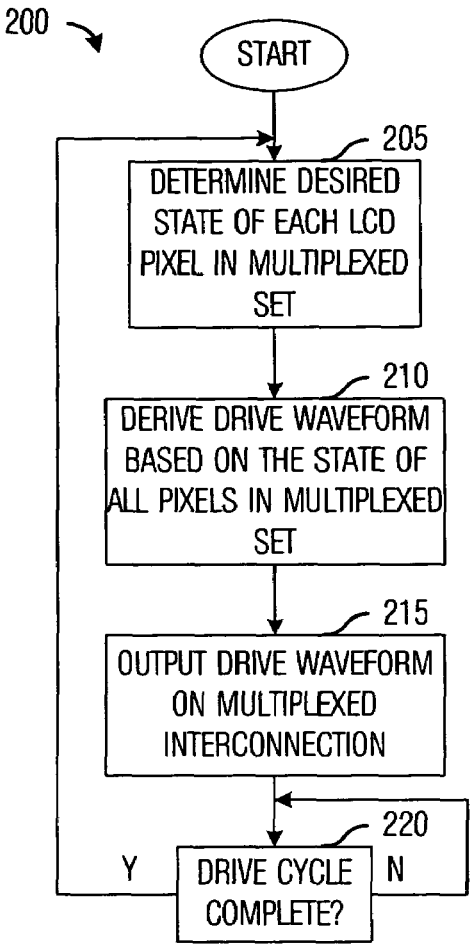
*Fig. 2*
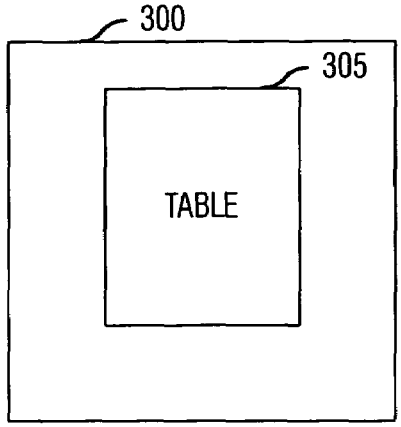
*Fig. 3a*
305
360 355
| INDEX | DRIVE WAVEFORM |
|---|---|
| 0 | DRIVE WAVEFORM_0 |
| 1 | DRIVE WAVEFORM_1 |
| 2 | DRIVE WAVEFORM_2 |
| 3 | DRIVE WAVEFORM_3 |
| 4 | DRIVE WAVEFORM_4 |
| 5 | DRIVE WAVEFORM_5 |
| 6 | DRIVE WAVEFORM_6 |
| 7 | DRIVE WAVEFORM_7 |
*Fig. 3b*

DATA-DEPENDENT, LOGIC-LEVEL DRIVE SCHEME FOR DRIVING LCD PANELS

TECHNICAL FIELD

The present invention relates generally to a system and method for displaying information, and more particularly to a system and method for a driving an LCD using a data-dependent, logic-level drive scheme.

BACKGROUND

Liquid crystal displays (LCDs) have become a common way to display information in electronic devices and computers. LCDs have advantages such as being thin and light (when compared to cathode ray tube displays) as well as being energy efficient. LCDs typically operate by regulating the transmission of light, wherein in one state, the transmission of light through a picture element is permitted while in a second state the transmission of light through the picture element is blocked.

An LCD is made up of a plurality of pixels (or segments) that can be turned on or off by applying a voltage potential across a common (or backplane) electrode and a select electrode that is associated with each pixel. The state of a pixel is determined by a root mean square voltage (Vrms) across its common electrode and select electrode. The voltage potential across the electrodes can energize a liquid crystal fluid so that it can either pass or block the flow of light. For example, when the Vrms is greater than a threshold voltage for the LCD, the pixel is ON. The pixel is OFF when the Vrms is less than the threshold voltage for the LCD. Furthermore, in order to prevent damage to the LCD since a DC voltage can deteriorate the liquid crystal fluid so that it can no longer be energized, there is a requirement that no DC offset be present across any and all pixels.

Since the state of each pixel can be independently controlled, each pixel can be driven by a signal that is provided by an interconnection. However, since many LCDs can have a very large number of pixels, sharing (multiplexing) a single connection between multiple pixels can be used to reduce the overall number of interconnections between an LCD and driver circuitry. For example, in an LCD with ⅓ multiplexing (a multiplex factor of 3), a single common electrode interconnection can be used to control the state of three pixels. It is not unusual for an LCD with a large number of pixels to have 1/64 or 1/128 (or higher) multiplexing, wherein a single common electrode interconnection can be used to control the state of 64 or 128 pixels.

A commonly used prior art technique to drive a signal that can be used to control the state the pixels of an LCD involves the use of analog output drivers and voltage charge pump circuitry to provide necessary multi-voltage level drive signals. The use of multi-voltage level drive signals can simplify the generation of drive signals for multiplexed LCDs as well as maximize a delta between Vrms ON and Vrms OFF in order to maximize LCD viewing contrast.

Another prior art technique that can be used to control the state of the pixels of an LCD is to drive these pixels directly with logic-level circuitry. The use of logic level signaling (typically a two level signal) permits the direct coupling of the LCD with the circuitry used to generate the drive signals.

One disadvantage of the prior art is that the use of analog output drivers and voltage charge pumps are typically more difficult and complex to integrate into an integrated circuit. The increased difficulty and complexity increases the cost of producing LCD control circuitry as well as potentially decreasing the reliability of the circuitry. Therefore, the use of analog output drivers and voltage charge pumps can result in a more expensive LCD drive system that is potentially less reliable.

A second disadvantage of the prior art is that the use of logic level signaling can result in a relatively small difference between on and off RMS voltage levels for controlling the state of a pixel, when compared to the difference achievable when using charge pumps and analog output drivers. With a small difference between the on and the off voltages, the contrast between a pixel in the on state and a pixel in the off state is small. Therefore, the visual quality of the LCD is not as good as when there is a large difference between the on and the off voltages.

SUMMARY OF THE INVENTION

These and other problems are generally solved or circumvented, and technical advantages are generally achieved, by preferred embodiments of the present invention which provides a system and method for driving an LCD using a data-dependant, logic-level drive scheme.

In accordance with a preferred embodiment of the present invention, a method for driving a liquid crystal display (LCD) pixel multiplexed set with a data dependent signal, wherein the LCD pixel multiplexed set contains a plurality of pixels is provided. The method includes determining a desired state of each pixel in the LCD pixel multiplexed set, deriving a drive waveform sequence based upon the state of all pixels in the LCD pixel multiplexed set, and outputting the drive waveform sequence to the LCD pixel multiplexed set.

In accordance with another preferred embodiment of the present invention, a method for computing a drive waveform for a liquid crystal display (LCD) pixel multiplexed set, wherein the LCD pixel multiplexed set contains a plurality of pixels is provided. The method includes computing a number of time slots based upon a number of pixels in the plurality of pixels, generating a set of common waveform sequences, and determining a number of potential drive waveforms. The method also includes calculating a root-mean squared (RMS) voltage value for each pixel in the LCD pixel multiplexed set. The RMS voltage values are calculated for each potential drive waveform sequence and common waveform sequence combination. The method then selects a potential drive waveform sequence for each possible combination of pixel values for the pixels in the LCD pixel multiplexed set.

In accordance with another preferred embodiment of the present invention, a liquid crystal display (LCD) drive circuit is provided. The LCD has a multiplex factor of N. The LCD drive circuit includes a processor that is configured to group data to be displayed on the LCD based upon a value of pixels in a multiplexed set, and a display logic circuit coupled to the processor. The display logic circuit is configured to derive a drive waveform based on the value of pixels in the multiplexed set. The LCD drive circuit also includes multiple select driver circuits coupled to the display logic circuit. Each select driver circuit to place a drive waveform onto a select signal line. Additionally, the LCD drive circuit includes a phase generator coupled to the processor. The phase generator continually places N common waveform sequences onto N common signal lines with each common waveform sequence on a unique common signal line.

An advantage of a preferred embodiment of the present invention is that a larger difference between an on and an off RMS voltage for controlling the state of a pixel of an LCD can in some cases be achieved as compared to prior art solutions, thereby increasing the contrast between an on pixel and an off pixel and improving the quality of the display.

A further advantage of a preferred embodiment of the present invention is that the use of logic level drive signals rather than analog drive circuits and voltage charge pumps can enable the easier integration of an LCD control and drive circuit into an integrated circuit. The integration can help to reduce the cost as well as increase the reliability of the LCD control and drive circuit.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 is a diagram of an algorithm for determining a drive waveform for a multiplexed set of LCD pixels, wherein the desired state of all LCD pixels in the multiplexed set are considered in the determining of the values of the drive waveform at any given point in time during an LCD frame period, according to a preferred embodiment of the present invention;

FIGS. 3*a* and 3*b* are diagrams of memory based systems for storing the values of drive waveforms, according to a preferred embodiment of the present invention;

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely an LCD with interconnect multiplexing of ⅓, ¼, and ⅕. The invention may also be applied, however, to other LCDs with other interconnect multiplexing values.

Figure 1A:
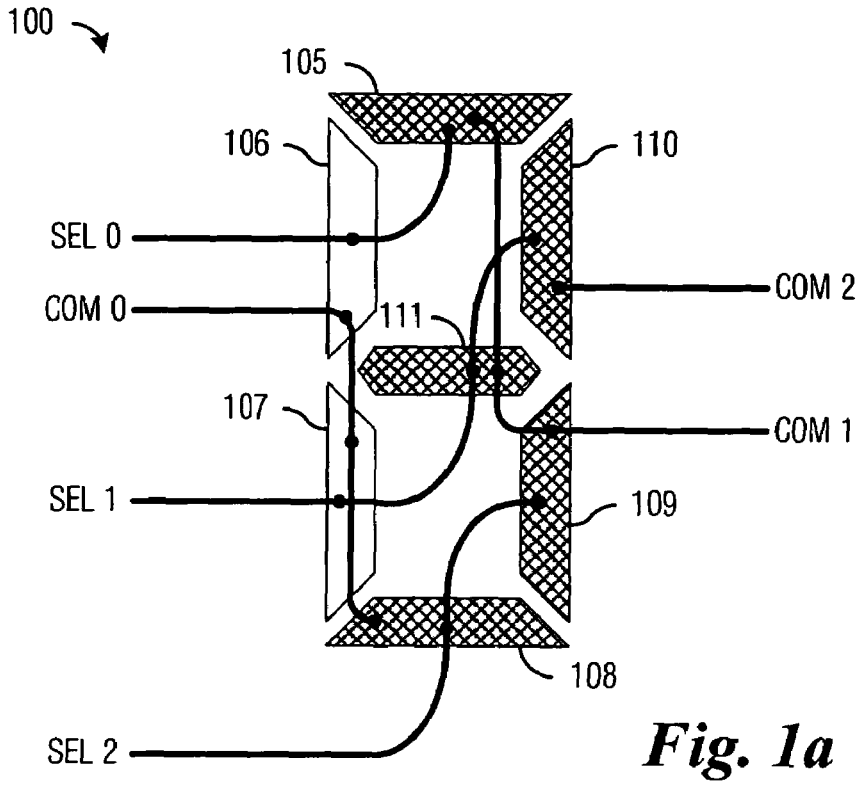
FIGS. 1*a* and 1*b* are diagrams of exemplary LCDs.
Figure 1B:
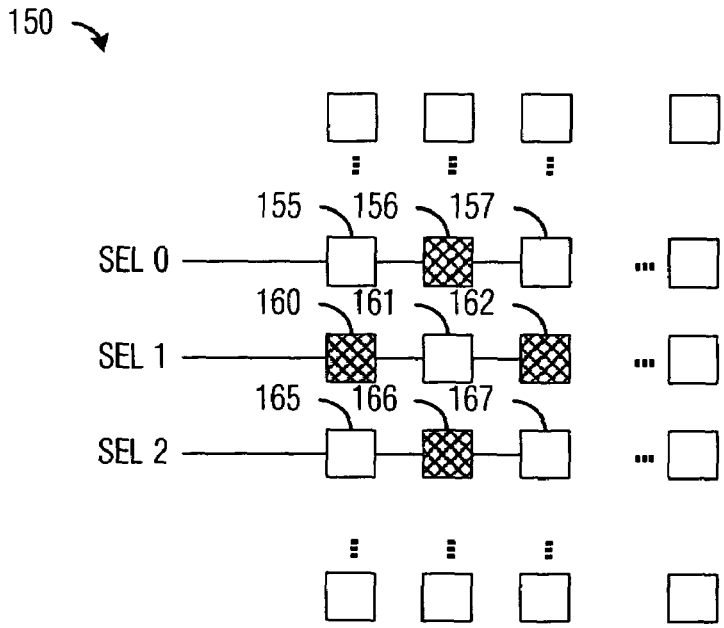

With reference now to FIGS. 1*a* and 1*b*, there are shown diagrams illustrating exemplary portions of LCDs. The diagram shown in FIG. 1*a* illustrates a seven-segment LCD 100 that is typically used to display numerical information. The seven-segment LCD 100 comprises seven segments (or pixels), such as segments 105, 106, and 107. As shown in FIG. 1*a*, the seven-segment LCD 100 is shown displaying a numeral "3." The numeral "3" can be displayed by setting segments 106 and 107 to a different state from segments 105, 108, 109, 110, and 111. For example, the segments 106 and 107 can be in an off state while the remaining segments of the seven-segment LCD 100 can be in an on state.

The seven-segment LCD 100, as shown in FIG. 1*a*, features ⅓ multiplexing of its interconnects. Since there are a total of seven segments, two interconnects can be used to drive three segments each while a remaining interconnect drives one segment. There are two types of interconnects, a select signal line and a common signal line. As discussed previously, the state of a segment (or pixel) is determined by an RMS voltage difference between its select terminal and its common terminal. The select signal line couples the select terminals for a plurality of segments and the common signal line couples the common terminals for a plurality of segments. For each segment in a group of segments with their select terminals coupled together by a single select signal line, their common terminals should be electrically disjoint, i.e., each segment should have its common terminal coupled to a different common signal line. For example, segments 105 and 106 can be coupled together by one select signal line, labeled "SEL 0," while segments 107, 110, and 111 can be coupled together by another select signal line, labeled "SEL 1," and segments 108 and 109 can be coupled together by yet another select signal line, labeled "SEL 2," while a common signal line, labeled "COM 0," can couple segments 106, 107, and 108 together, another common signal line, labeled "COM 1," can couple segments 109, 111, and 105 together, and a final common signal line, labeled "COM 2," can be connected to segment 110.

The diagram shown in FIG. 1*b* illustrates a portion of an LCD 150, wherein the LCD 150 comprises a plurality of pixels arranged in a matrix-like arrangement. As shown, the LCD 150 is made up of pixels, such as pixel 155, 156, and 157, which are square in shape. However, the shape of the pixels in an LCD can vary depending upon implementation and imaging requirements. As with the seven-segment LCD 100 (FIG. 1*a*), the LCD 150 features ⅓ multiplexing of its interconnects. For example, pixels 155, 156, and 157 share a select signal line labeled "SEL 0," pixels 160, 161, and 162 share an select signal line labeled "SEL 1," and pixels 165, 166, and 167 share another select signal line labeled "SEL 2." Although not shown in FIG. 1*b*, common signal lines can be arranged in a vertical fashion through the pixels of the LCD 150. For example, a common signal line can couple pixels 155, 160, and 165 together.

Since it is necessary for the drive voltage across all pixels to have zero DC offset, the values of the drive signal cannot simply be the desired value of the pixel. For example, if an interconnect is driving a single pixel, the drive signal cannot be a single value signal that is necessary to set the pixel to the desired state since this would result in the drive signal having a non-zero DC offset. The values of the drive waveform for a given interconnect are dependent upon the desired value of the pixels being driven by the interconnect as well as the need to have a zero DC offset.

With reference now to FIG. 2, there is shown a diagram illustrating an algorithm 200 for determining the drive waveform sequence for a multiplexed set of LCD pixels (segments), wherein the desired state of all LCD pixels in the multiplexed set are considered in the determining of the values of the drive waveform sequence at any given point in time during an LCD frame period, according to a preferred embodiment of the present invention. Previous techniques that have been proposed for determining the value of the drive waveform sequence for a multiplexed set of LCD pixels at any given point in time during an LCD frame period have considered the desired state of the LCD pixels in an independent manner (i.e. only one of the pixels in the multiplexed set is used in determining the value of the signal waveform at a given time). For example, in a ⅓ multiplexed interconnection, the state of pixel number one has the same effect on the value of the drive waveform sequence in a specific period of time within the LCD frame regardless (independent) of the states of pixels number two or number three. This implies that there is no data-dependency between the pixels in the multiplexed set during an LCD frame period.

However, it can be possible to increase a delta RMS voltage between the on state voltage and the off state voltage of the LCD pixels in the multiplexed set by considering the state of all of the LCD pixels in the multiplexed set when determining the values of the drive waveform sequence. For example, referring back to the ⅓ multiplexed interconnection, the effect on the drive waveform sequence by the desired state of pixel number one can be different, depending upon the desired states of pixels number two and number three. Therefore, in the determining of the values of the drive waveform sequence, the desired states of all LCD pixels in the multiplexed set should be considered.

According to a preferred embodiment of the present invention, the algorithm 200 can execute on a display controller, a display driver circuit, a general purpose controller, a processing element, or some other circuit that can have the responsibility of generating the drive signals for an LCD. The display controller (not shown) can begin by determining the desired state of each LCD pixel in a multiplexed set (block 205). If there is more than one multiplexed set of LCD pixels (i.e. more than one select signal line), the display controller can determine the desired state of each LCD pixel in each multiplexed set. The determining of the desired state of each LCD pixel can be performed by referencing a memory that is used to store the information that is to be displayed on the LCD, such as a display memory (not shown), and retrieving values stored in memory locations corresponding to the individual LCD pixels in the multiplexed set, for example.

After determining the desired state of each LCD pixel in the multiplexed set, the display controller can derive the drive waveform sequence based upon the determined desired states of all of the LCD pixels in the multiplexed set (block 210). According to a preferred embodiment of the present invention, the LCD pixels in the multiplexed set can be arranged in a specified order to generate an index that can be used to access a memory or a storage table to retrieve the values of the drive waveform sequence. For example, if the multiplexed set contains three LCD pixels: pixels number one, number two, and number three, then the desired states of the LCD pixels can be arranged in a specified order, such as a binary arrangement wherein state_pixel_number_one*2^2+state_pixel_number_two*2^1+state_pixel_number_three*2^0=INDEX, to compute the index into the memory. The drive waveform sequence can then be retrieved by referencing the memory with the index, INDEX. As an example, if the desired states of the three LCD pixels are as follows: pixel_number_one=ON (1), pixel_number_two=OFF (0), and pixel_number_three=ON (1), then INDEX=1*2^2+0*2^+1*2^=4+0+1=5. Alternatively, the drive waveform sequence can be derived (or generated) on the fly after the display controller has determined the desired state of each LCD pixel in the multiplexed set. This may be accomplished by having a sequence generator that can generate the needed values for the drive waveform sequence based upon the desired states of the LCD pixels. An advantage of generating the drive signal on the fly is a potentially significant reduction in storage requirements, which can be especially advantageous when the number of LCD pixels being multiplexed on any given interconnect is large.

After deriving (or generating) the drive waveform sequence (block 210), the display controller can then output the drive waveform sequence on the multiplexed interconnection (block 215). The values of the drive waveform sequence have a finite duration and change over the LCD frame time period. The display controller may need to buffer the values of the drive waveform sequence so that the appropriate signal level can be properly outputted onto the multiplexed interconnection at the appropriate time. Alternatively, the drive controller can store the memory index of the drive waveform sequence and the index can be used to reference the memory to retrieve the values of the drive waveform sequence as needed. For example, the drive controller can store the index, such as the number five (5) from the discussion above, and associate the index with the multiplexed interconnection. Then, the index can be used to retrieve the values of the drive waveform sequence and the values can then be outputted onto the multiplexed interconnection.

The total time required to completely output the drive waveform sequence onto the multiplexed interconnection before repeating the cycle is typically referred to as the LCD frame period. The inverse of the LCD frame period is commonly referred to as the LCD frame frequency. System designers typically set the LCD frame frequency for an LCD in the range of 70 to 100 Hz. If set too low, LCD flickering can occur, while setting the LCD frame frequency too high can result in unnecessary power consumption. Because the LCD frame period is essentially constant, the amount of time that the display controller has to drive a specific signal value within a completed drive waveform sequence will decrease as the number of pixels in a multiplexed set increases. Consequently, the amount of time that the controller has to drive a specific state within the drive waveform sequence can be determined by dividing the LCD frame period by a number of total number of states (or time slots) in the drive waveform sequence. To ensure that zero DC offset is presented to the LCD pixels, the drive controller can simply drive the interconnect with an inverted version of the drive waveform sequence on both the select and common interconnects on alternating LCD frame periods.

With reference now to FIGS. 3*a* and 3*b*, there are shown diagrams illustrating a memory based system for storing the values of the drive waveform sequences, according to a preferred embodiment of the present invention. The diagram shown in FIG. 3*a* illustrates a memory 300 that can be used to store a table 305 that contains the drive waveform sequences for various possible combinations of LCD pixel states. The table 305 may be a portion of the memory 300 or it may consume the entire memory, i.e., the memory 300 may be dedicated to storing the table 305. The table 305 can be commonly referred to as being a look-up table or a translation table.

The diagram shown in FIG. 3*b* illustrates a detailed view of the table 305. The table 305 can store the drive waveform sequences, such as drive waveform_0 355. The value of the drive signal can be stored in a table entry with an index that corresponds to the index computed for the states of the LCD pixels. For example, drive waveform_0 355 can be stored in a table entry with index zero (0). The diagram shows an index, such as index 360, for each stored drive waveform sequence. However, the index may not actually be stored in the table 305, but may arise naturally from the way that entries in the table 305 are addressed. For example, when address data lines (not shown) for the memory 300 are set to zero (0), they may naturally address a table entry where the value of drive waveform_0 355 is stored.

Figure 4A:
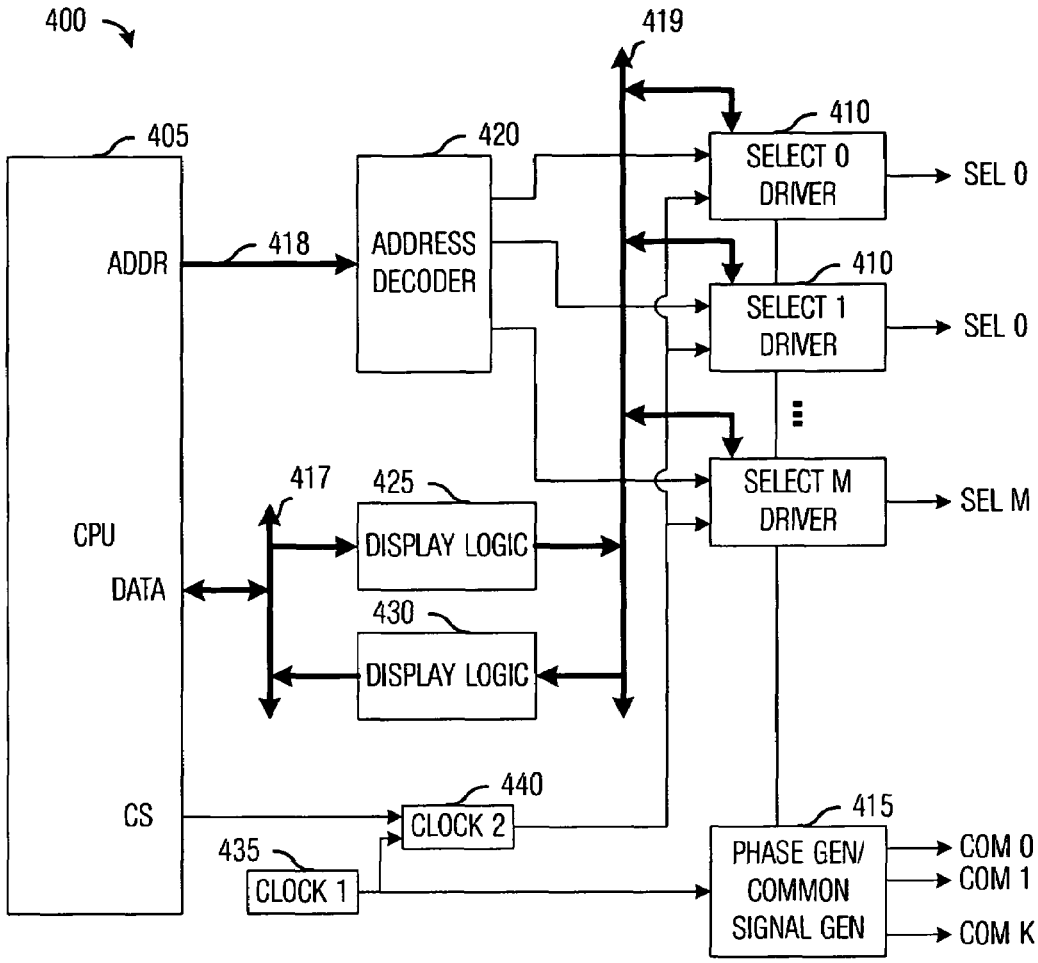
FIGS. 4*a* through 4*c* are diagrams of a system for displaying information on an LCD, according to a preferred embodiment of the present invention.
Figure 4B:
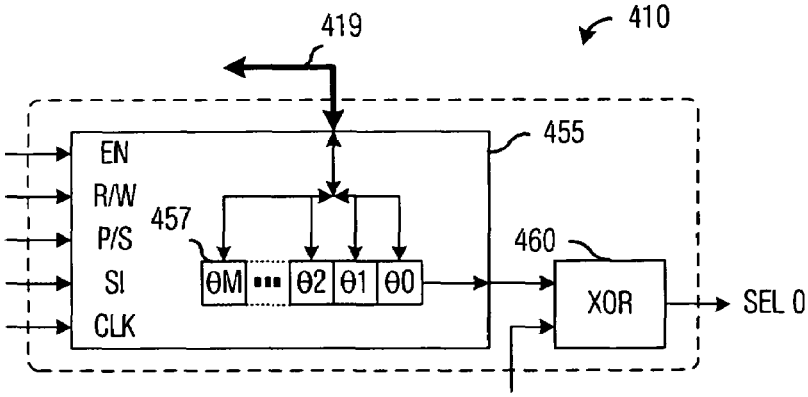
Figure 4C:
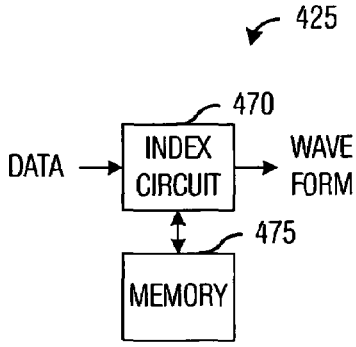

With reference now to FIGS. 4*a* through 4*c*, there are shown diagrams illustrating a system for displaying information on an LCD and a detailed view of a segment driver circuit and a display logic circuit, wherein the drive waveform sequences for the LCD are generated with consideration for data-dependency, according to a preferred embodiment of the present invention. The diagram shown in FIG. 4*a* illustrates a system 400 for displaying information on an LCD, wherein the LCD uses 1/N multiplexing with N being an integer number. According to a preferred embodiment of the present invention, the system 400 may be a part of an electronic device that includes an LCD or the system 400 may be a stand-alone product that can be used to permit the attachment and drive of an LCD to an existing electronic device. For example, the system 400 may be a single chip solution sold to developers of electronic devices desiring the ability to make use of an LCD.

The system 400 can include a central processing unit (CPU) 405. The CPU 405 can be used to perform tasks such as grouping data that is to be displayed on the LCD into groups that is divided along their respective segments, computing graphical information, generating content to be displayed, computing data to be displayed, and so forth. The tasks performed by the CPU 405 can be dependent upon the nature of the system 400. For example, if the system 400 is a part of a stand alone electronic device, then the CPU 405 may be responsible for performing more tasks than if the system 400 were a single chip solution that was intended to function as an interface between an electronic device and an LCD.

An LCD can be divided into a plurality of pixels that can be grouped into multiplexed sets, with the number of multiplexed sets in the LCD being dependant upon the multiplexing of the display. For example, a ⅕ multiplexed LCD will have its pixels grouped into multiplexed sets of five pixels each. Each multiplexed set will have a select driver 410 and a select signal line. Select drivers 410 can be used to put needed signals onto a select signal line to turn on and off the pixels of the multiplexed set. For an LCD with K pixels, the number of select signal lines needed is equal to K/N with N being a degree of multiplexing.

In order to turn on (or turn off) a pixel, an RMS voltage realized across the pixel must be above (or below) a threshold value. The RMS voltage across a pixel can be defined as an RMS voltage potential seen across the select signal line and a common signal line associated with the pixel. A phase generator and common signal generator 415 can be used to provide the common waveform sequence on a common signal line. As in the case with the select signal lines, each pixel of the LCD is associated with only one common signal line. According to a preferred embodiment of the present invention, the common waveform sequence provided to a common signal line is a predetermined sequence that is continually repeated and is, therefore, not dependent on the state of any pixel in the LCD. Therefore, it can be possible to implement the phase generator and common signal generator 415 as a plurality of memory elements (not shown) that is capable of storing the desired values of the common waveform sequences and a plurality of signal drivers (not shown) that can read the values for the common waveform sequences from the memory elements and assert the values onto the respective common signal lines. Alternatively, an array of shift registers can be used to shift out the desired values of the common waveform sequences onto the various common signal lines.

The CPU 405 can provide the data to be displayed on each multiplexed set of pixels during each display refresh cycle by providing the data to a data bus 417 and a select number (or select address) to an address bus 418. An address decoder 420 can convert the select number (or select address) and enable a proper select driver 410. When properly enabled by the address decoder 420, the select driver 410 can read the data (the drive waveform sequences) from a second data bus 419 and drive the select signal line.

In many circumstances, the data to be displayed by a particular multiplexed set (or select signal grouping) of pixels (the data that the CPU 405 will provide to the data bus 417) must be converted into a form that is compatible with the LCD. A display logic circuit 425 can be used to convert the data to be displayed by a particular multiplexed set of pixels into a form that is compatible with the LCD, i.e., convert the data to be displayed into drive waveform sequences. According to a preferred embodiment of the present invention, the display logic circuit 425 can make use of a table, such as the table 305 (FIG. 3*b*) to perform the necessary conversion of the data. As previously discussed, the data that is to be displayed can be collectively used as an index to the table 305. Located at a memory location indexed by the data is a series of signal values (the drive waveform sequence) that, when provided to the multiplexed set of LCD pixels, will properly display the data. On occasion, it may be necessary for the CPU 405 to perform a reverse translation from the drive waveform sequence back to the data to be displayed. In such an occasion, a second display logic circuit 430 can be used to perform the necessary translation, which can be an inverse operation of the operation performed by the display logic circuit 425.

A pair of clocks, clock #1 435 and clock #2 440 can be used to provide necessary timing information for the system 400. The clock #1 435 can be used to provide a timing signal for the phase generator and common signal generator 415. As such, the clock #1 435 can be configured to continually provide its clock signal as long as it is being powered. In addition to providing timing signal information for the phase generator and common signal generator 415, the clock #1 435 can also provide timing information that can be used by the select drivers 410 for providing the values of the drive waveform sequences to their respective select signal lines. The select drivers 410 can also make use of a clock signal as an indicator of when to capture a value on the second data bus 419. This clock signal can be provided by the CPU 405. The clock #2 440 can be a combination of the clock signal generated by the clock #1 435 (used to clock the providing of the drive waveform sequences to the select signal lines) and the clock signal provided by the CPU 405 (used to clock the capture of the drive waveform sequences on the second data bus 419). The clock #2 440 may be implemented as a multiplexer that can selectively couple an output of the clock #1 435 or the clock signal generated by the CPU 405 to the select drivers 410.

The diagram shown in FIG. 4*b* illustrates a detailed view of a segment driver 410. According to a preferred embodiment of the present invention, the select driver 410 can include a shift register 455 and signal inverting/non-inverting logic 460. The shift register 455 may be implemented using a memory 457 that can have adequate storage space to store the values of the drive waveform sequence to be put onto the select signal line. Preferably, the memory 457 can be loaded in a single clock cycle from the second data bus 419 and then on each subsequent clock cycle, a value can be shifted out of the memory 457 to the signal inverting/non-inverting logic 460. As the values are shifted out of the memory 457, the values can be saved by performing a circular shift. The signal inverting/non-inverting logic 460 can be used to create the inverted/non-inverted signals in alternating LCD frame periods as described previously. It can be implemented as a logical exclusive-or (XOR) gate with one input being the output of the memory 457 and another input being an inverting signal enable that can be provided by the phase generator and common signal generator 415, for example.

An alternative embodiment of the select drivers 410 and system 400 can enable a reduction in the width of the second data bus 419 and the complexity of the select drivers 410 by providing a single value of the drive waveform sequence per clock cycle rather than all values of the drive waveform sequence in the single clock cycle. Alternatively, a different embodiment of the select drivers 410 and the system can be a compromise in situations where the drive waveform sequences are long (for LCDs with high multiplexing). In such a situation, the second data bus 419 may be set so that it is wider than a single value but not wide enough for all values of the drive waveform sequence and several clock cycles may be needed to transfer all of the values of a drive waveform sequence to the select driver 410.

The diagram shown in FIG. 4*c* illustrates a detailed view of an exemplary display logic circuit 425. The display logic circuit 425 includes an index circuit 470 and a memory 475. The index circuit 470 can take the data from the CPU 405 and can compute an index value based upon the data. The index value can then be used access the memory 475 to retrieve the drive waveform sequence. Alternatively, a sequence generator (not shown) can be used in place of the memory 475. When the index circuit 470 provides the index value to the sequence generator, the sequence generator can dynamically generate the drive waveform sequence based on the index value.

Figure 5:
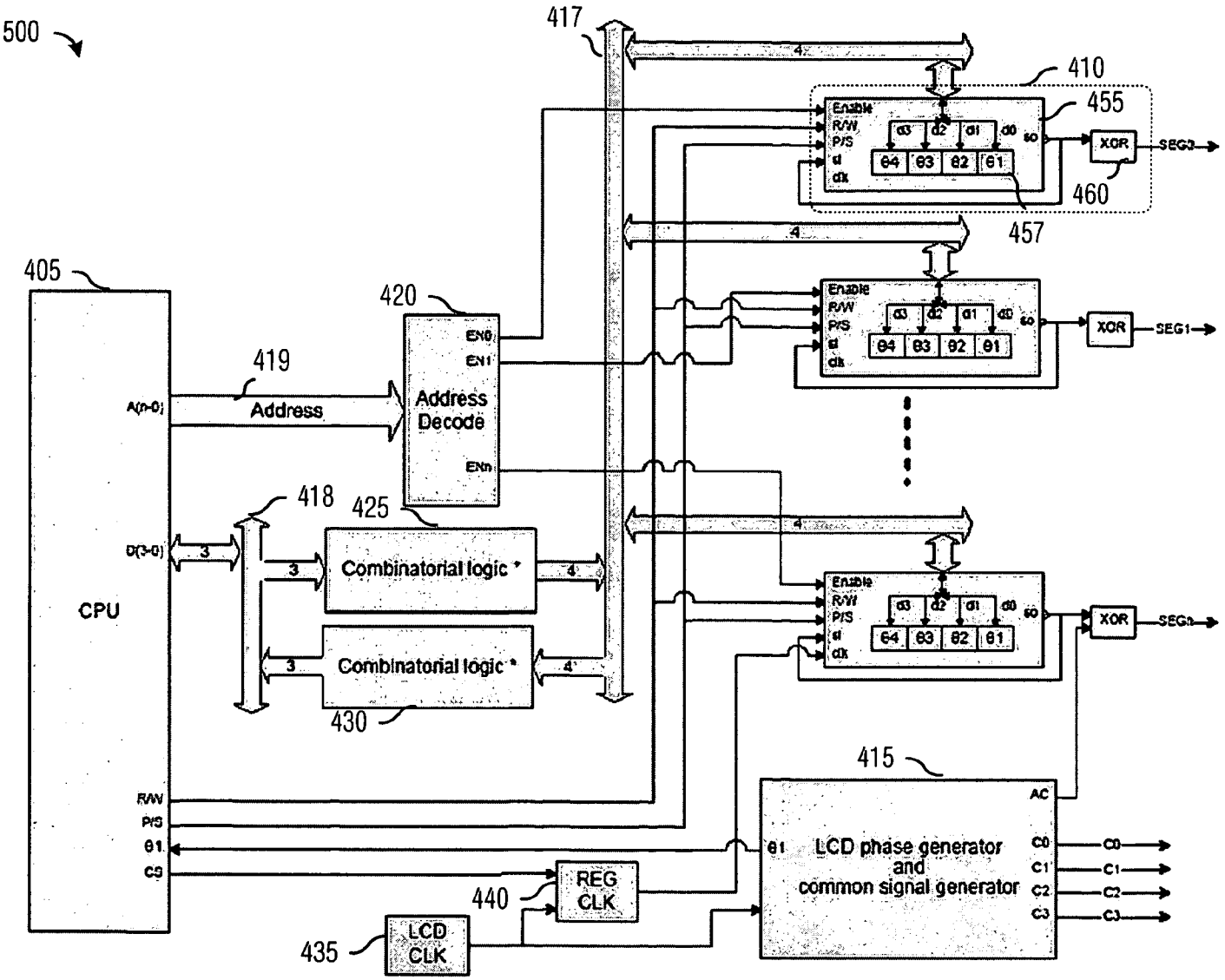
FIG. 5 is a diagram of an exemplary system for displaying information on an LCD with ⅓ multiplexing, according to a preferred embodiment of the present invention.

With reference now to FIG. 5, there is shown a diagram illustrating an exemplary system 500 for displaying information on an LCD with ⅓ multiplexing, according to a preferred embodiment of the present invention. With ⅓ multiplexing, each select signal line is responsible for driving three pixels of the LCD. Therefore, the data bus 418 should have a data width that is adequate to transport the values of the three pixels in a single clock cycle. According to a preferred embodiment of the present invention, the drive waveform sequence needed for a ⅓ multiplexed LCD requires four values, therefore the second data bus 419 should have adequate data width the transport the four values in the drive waveform sequence for each multiplexed set in a single clock cycle. A discussion of the computation of the values needed for the select signal lines is provided below.

Figure 6:
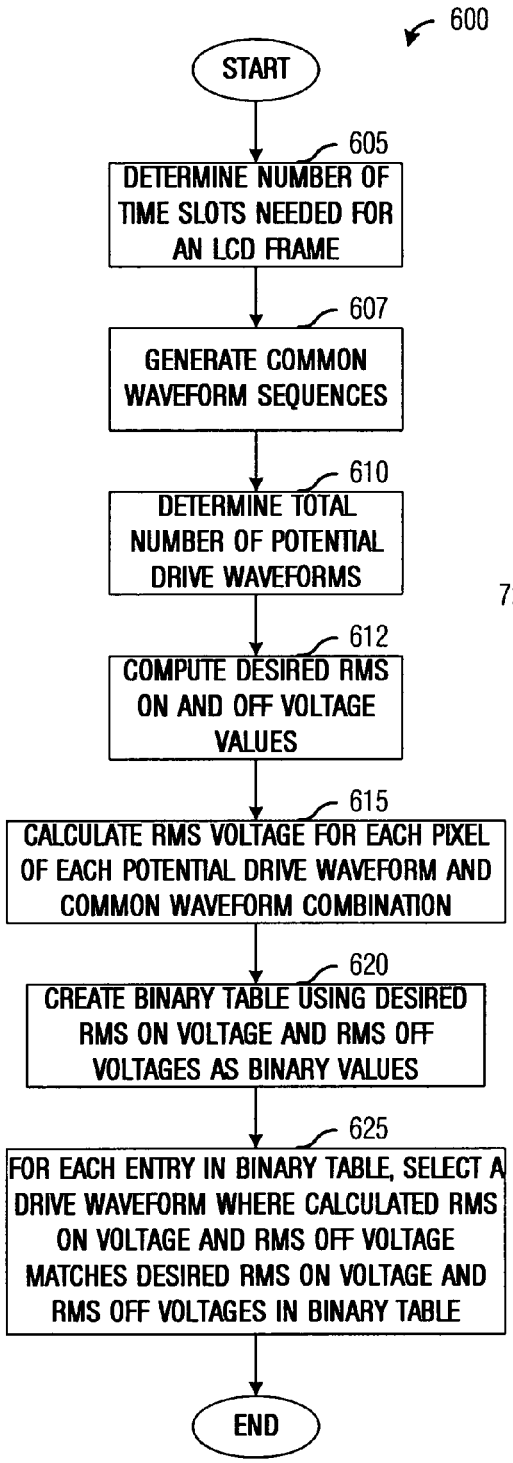
FIG. 6 is a diagram of an algorithm for use in computing and selecting drive waveform signal values for the select signal lines, according to a preferred embodiment of the present invention.

With reference now to FIG. 6, there is shown a flow diagram illustrating an algorithm 600 for use in computation of drive waveform sequences and common waveform sequences to be used on select signal lines and common signal lines of a multiplexed LCD, according to a preferred embodiment of the present invention. According to a preferred embodiment of the present invention, the algorithm 600 can be used to compute the drive waveform sequences that are to be provided to the select signal lines, as well as the common waveform sequences for the common signal lines. The algorithm 600 can be executed on a general purpose computer, a specifically designed processor, a custom designed integrated circuit, or so forth. The computation of the values of the drive waveform sequences for the select signal lines and the common waveform sequences for the common signal lines can be computed a priori and then stored within a system for driving an LCD, such as the system 400, so that the drive waveform sequences of the select signal lines and the common waveform sequences for the common signal lines can be available for use without requiring significant processing time or processor power.

The algorithm 600 can begin after a set of specifications for an LCD is provided. The specifications can specify the degree of multiplexing, the number of select signal lines needed, the number of pixels per select signal line, the number of common signal lines, the duration of the LCD frame period, and so forth. With the specifications for the LCD provided, it is now possible to determine a number of time slots needed for the LCD frame (block 605). Each value asserted on the select signal line and the common signal line is maintained for a specified amount of time (a time slot), therefore, the number of time slots is also an indicator of the number of values to be provided to the select signal lines and the common signal lines. The number of time slots needed for a given degree of multiplexing can be expressed as: Num_time_slots=(Num_pixels_per_select_signal_line*2)−2, wherein Num_pixels_per_select_signal_line is the number of pixels driven by a single select signal line. For example, in an LCD with ⅓ multiplexing, each select signal line drives three pixels, therefore, Num_time_slots=(3*2)−2=4. The value Num_time_slots is equal to the total number of time slots in an LCD frame period.

After determining the number of time slots in each LCD frame period (block 605), the common waveform sequences can be generated (block 607). Although a large variety of waveforms can be used for the common waveform sequence, some sequences can be better than others. For example, some sequences may be easier to generate via hardware techniques, while others may use less power when the values of the sequences are driven onto the common lines. An example of good common waveform sequences can be generated by having the sequences meet two criteria. A first criterion is that all sequences should have only a single high-value state, such as a state "1" in a binary active high system. A second criterion is that for a given unique time slot, there should be only one single state "1." The exemplary common waveform sequences can easily be generated by marching a single "1" through the different sequences.

After determining the number of time slots in each LCD frame period (block 605) and computing the common waveform sequences (block 607), a total number of potential drive waveform sequences that can be provided to the select signal lines can be determined (block 610). According to a preferred embodiment of the present invention, since each value within a time slot can have one of two values, the total number of potential drive waveform sequences can be expressed as: Num_sequences=Num_time_slots ^2. The potential drive waveform sequences themselves can be generated by listing every possible binary sequence of length equal to Num_time_slots. Referring back to the above discussed example of the LCD with ⅓ multiplexing, with Num_time_slots=4, the Num_sequences=4^2=16 and the potential drive waveform sequences can be a list of 16 unique four-valued sequences, wherein each value is a binary value.

After the generation of the potential drive waveform sequences, the desired RMS off voltage (Vrmsoff) and RMS on voltage (Vrmson) is computed using the formulas below (block 612):

$$Vrmsoff=Vdd*sqrt((Num_time_slots/2-1)Num_time_slots)$$

$$Vrmson=Vdd*sqrt((Num_time_slots/2+1)Num_time_slots)$$

Wherein Vdd is the voltage level represented by logic state "1."

Then, for each potential value sequence and sequence of values to be provided to the common signal line (block 615), the RMS voltage across each pixel in the multiplexed set is computed. For example, referring back to the above discussed example of the LCD with ⅓ multiplexing, for a given potential value sequence, an RMS voltage for each of the three pixels in a single select signal line can be computed. A first pixel RMS voltage value can be computed with the given potential value sequence and a first sequence of values to be provided to the common signal line, a second pixel RMS voltage value can be computed with the given potential value sequence and a second sequence of values to be provided to the common signal line, and a third pixel RMS voltage value can be computed with the given potential value sequence and a third sequence of values to be provided to the common signal line.

Then, a binary table with a size (number of columns) equal to the number of pixels coupled to a select signal line may be created (block 620). However, rather than using 0's and 1's in the binary table, the '0' values can be replaced with the desired Vrmsoff voltage value, and the '1' values can be replaced with the desired Vrmson voltage value (both values computed above, in block 612). Using the binary table, for each entry in the binary table, a drive waveform sequence with a computed sequence of pixel RMS voltage values that results in a match in the desired RMS off voltage and the desired RMS on voltage results is found (block 625). If more than one potential drive waveform sequence has a computed sequence of pixel RMS voltage values that match, then one potential drive waveform sequence may be selected at random. The selected potential drive waveform sequence will be the sequence of values that will be provided to the select signal line when it is desired that the pixels in the select signal line be set to a certain state. After selecting a potential drive waveform sequence for each entry in the binary table, the drive value sequences can be stored for subsequent use and the algorithm 600 can terminate.

Figure 7:
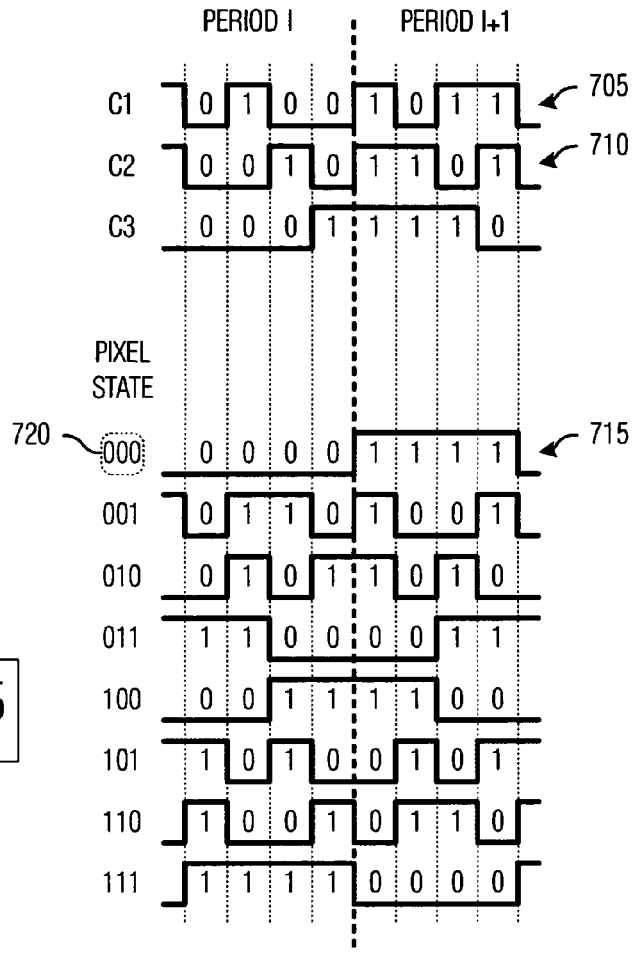
FIG. 7 is a diagram of drive waveform and common waveform sequences for an exemplary ⅓ multiplexed LCD, according to a preferred embodiment of the present invention.

With reference now to FIG. 7, there is shown a diagram illustrating a series of drive waveform sequences for select signal lines with a common signal line sequence for an exemplary ⅓ multiplexed LCD, according to a preferred embodiment of the present invention. As illustrated, two periods of the drive waveform sequences are shown, a non-inverted period (shown as period I) and an inverted period (shown as period I+1). The series of drive waveform sequences for select signal lines shown in FIG. 7, can be computed using the algorithm 600 (FIG. 6) for the displayed common signal line sequences, such as sequences 705 and 710, which can be repetitively provided to common signal lines "C1" and "C2," respectively. Drive waveform sequence 715 is a sequence of values that can be provided to a select signal line when it is desired that the pixels connected to that select signal line be set to the state "0 0 0" (as shown in highlight 720). The labels adjacent to a drive waveform sequence for a select signal line indicate the state the pixels connected to a select signal line will be set to when the drive waveform sequence is provided to the select signal line. As displayed in FIG. 7, for common signal line sequences of "0100," "0010," and "0001," the algorithm 600 computes the drive waveform sequences for the select signal lines to be:

| Index | Sequence |
|---|---|
| 000 | 0000 |
| 001 | 0110 |
| 010 | 0101 |
| 011 | 1100 |
| 100 | 0011 |
| 101 | 1010 |
| 110 | 1001 |
| 111 | 1111 |

If the common signal line sequences used by the algorithm 600 are shifted, for example, a right shift or a left shift, the drive waveform sequences for the shifted common signal line sequence can readily computed by simply performing the same shift on the drive waveform sequences. For example, if the common signal line sequences are shifted to the right by one bit, the drive waveform sequences for the shifted common signal line sequences can be derived by simple shifting the drive waveform sequences to the right by one bit, rather than needing to apply the algorithm 600 to the shifted common signal line sequences.

Figure 8:
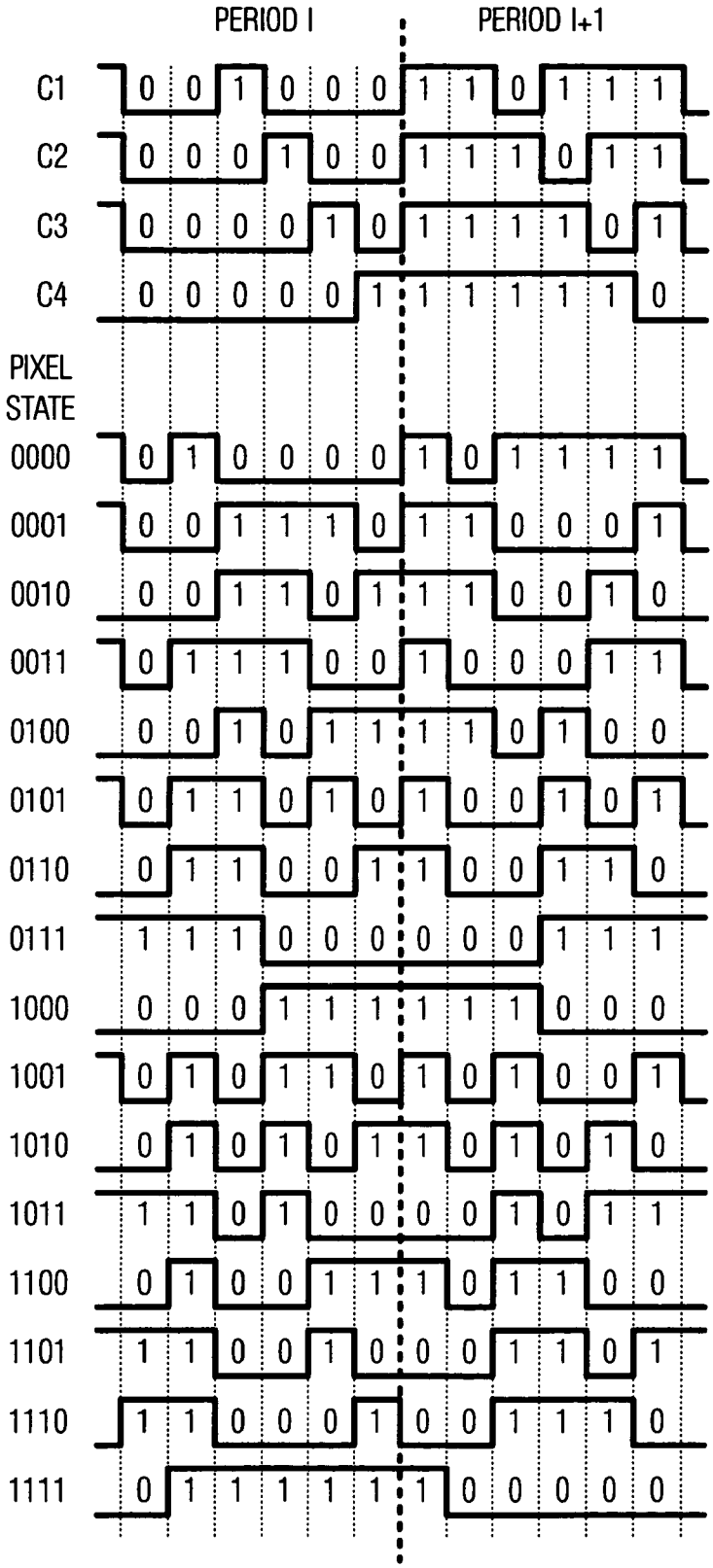
FIG. 8 is a diagram of drive waveform and common waveform sequences for an exemplary ¼ multiplexed LCD, according to a preferred embodiment of the present invention.

With reference now to FIG. 8, there is shown a diagram illustrating a series of drive waveform sequences for select signal lines with a common signal line sequence for an exemplary ¼ multiplexed LCD, according to a preferred embodiment of the present invention. As illustrated, two periods of the drive waveform sequences are shown, a non-inverted period (shown as period I) and an inverted period (shown as period I+1). As displayed in FIG. 8, for common signal line sequences of "001000," "000100," "000010," and "000001," the algorithm 600 computes the drive waveform sequences for the select signal lines to be:

| Index | Sequence |
|---|---|
| 0000 | 010000 |
| 0001 | 001110 |
| 0010 | 001101 |
| 0011 | 011100 |
| 0100 | 001011 |
| 0101 | 011010 |
| 0110 | 011001 |
| 0111 | 111000 |
| 1000 | 000111 |
| 1001 | 010110 |
| 1010 | 010101 |
| 1011 | 110100 |
| 1100 | 010011 |
| 1101 | 110010 |
| 1110 | 110001 |
| 1111 | 011111 |

Figure 9A:
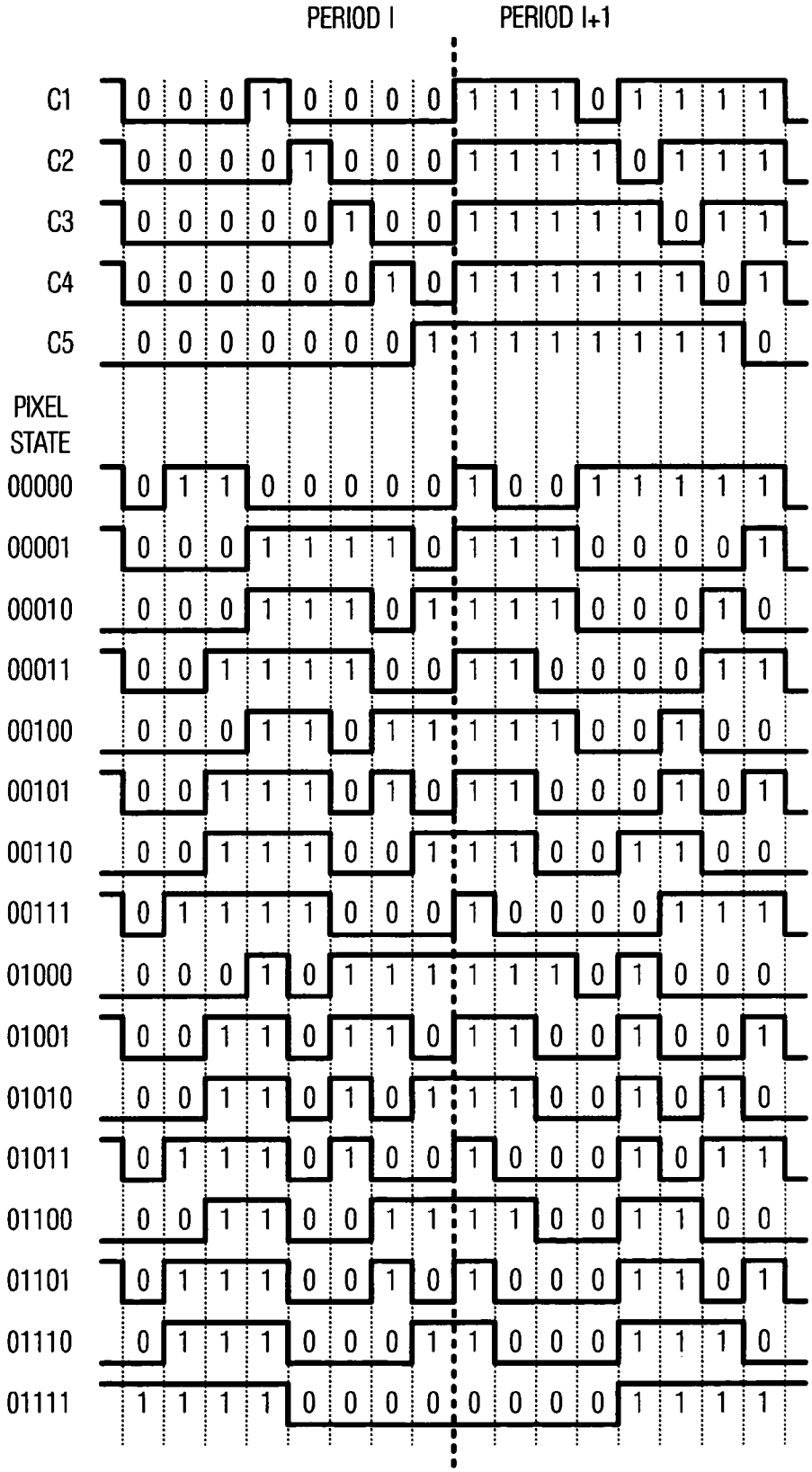
FIGS. 9*a* and 9*b* are diagrams of drive waveform and common waveform sequences for an exemplary ⅕ multiplexed LCD, according to a preferred embodiment of the present invention.
Figure 9B:
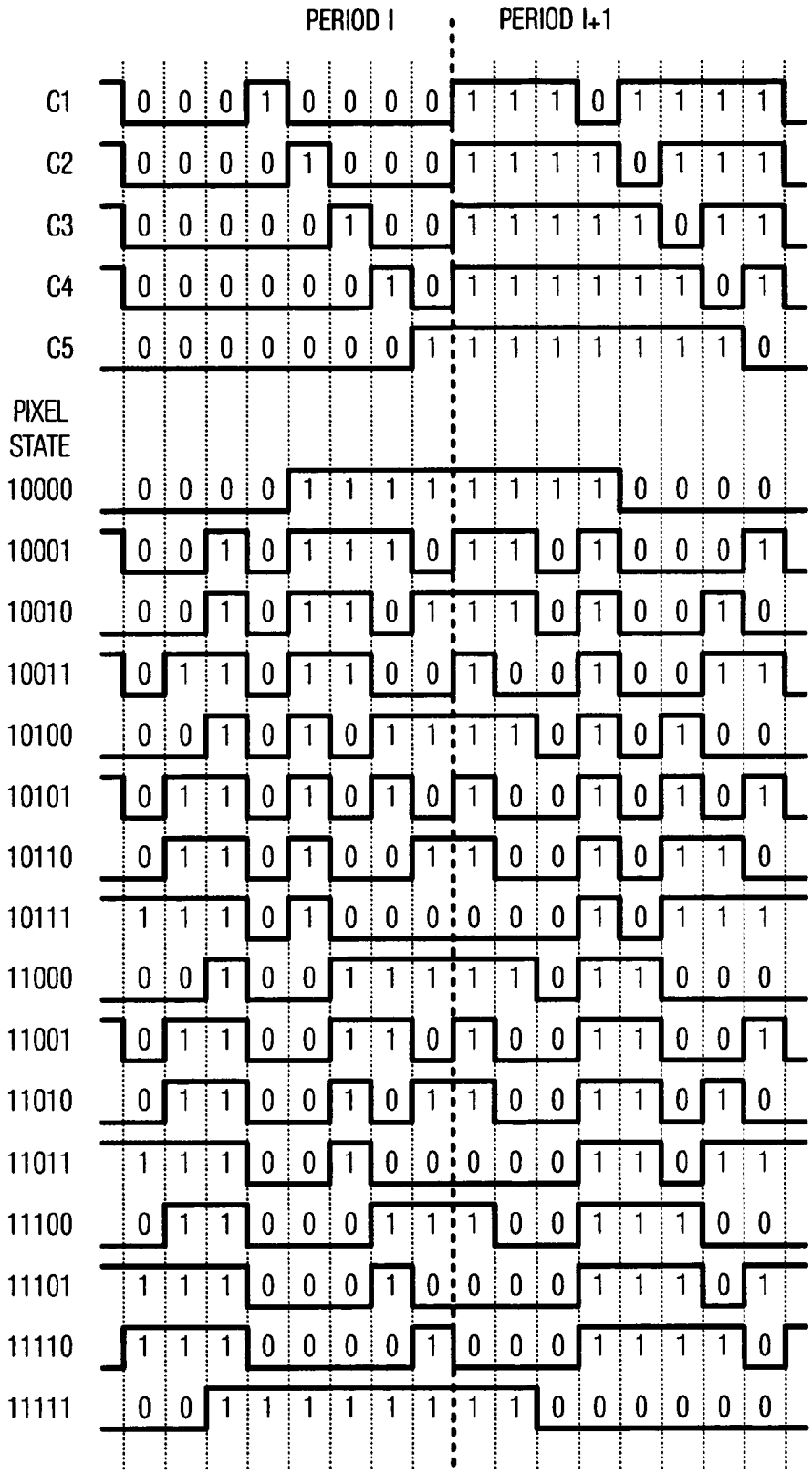

With reference now to FIGS. 9*a* and 9*b*, there are shown diagrams illustrating a series of drive waveform sequences for select signal lines with a common signal line sequence for an exemplary ⅕ multiplexed LCD, according to a preferred embodiment of the present invention. As illustrated, two periods of the drive waveform sequences are shown, a non-inverted period (shown as period I) and an inverted period (shown as period I+1). As displayed in FIGS. 9*a* and 9*b*, for common signal line sequences of "00010000," "00001000," "00000100," "00000010,"and "000001," the algorithm 600 computes the drive waveform sequences for the select signal lines to be:

| Index | Sequence |
|---|---|
| 00000 | 01100000 |
| 00001 | 00011110 |
| 00010 | 00011101 |
| 00011 | 00111100 |
| 00100 | 00011011 |
| 00101 | 00111010 |
| 00110 | 00111001 |
| 00111 | 01111000 |
| 01000 | 00010111 |
| 01001 | 00110110 |
| 01010 | 00110101 |
| 01011 | 01110100 |
| 01100 | 00110011 |
| 01101 | 01110010 |
| 01110 | 01110001 |
| 01111 | 11110000 |
| 10000 | 00001111 |
| 10001 | 00101110 |
| 10010 | 00101101 |
| 10011 | 01101100 |
| 10100 | 00101011 |
| 10101 | 01101010 |
| 10110 | 01101001 |
| 10111 | 11101000 |
| 11000 | 00100111 |
| 11001 | 01100110 |
| 11010 | 01100101 |
| 11011 | 11100100 |
| 11100 | 01100011 |
| 11101 | 11100010 |
| 11110 | 11100001 |
| 11111 | 00111111 |

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiment of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for driving a liquid crystal display (LCD) pixel multiplexed set with a data dependent signal, wherein the LCD pixel multiplexed set contains a plurality of pixels, the method comprising:

determining a desired state of each pixel in the LCD pixel multiplexed set;

deriving a drive waveform sequence based upon the state of all pixels in the LCD pixel multiplexed set;

calculating a root-mean squared (RMS) voltage value for each pixel in the LCD pixel multiplexed set for each potential drive waveform sequence and common waveform sequence combination, wherein the RMS on voltage and the desired RMS off voltage are computed using expressions Vrmsoff=Vdd*sqrt((Num time slots/ 2−1)/ Num time slots) and Vrmson=Vdd*sqrt((Num time slots/2+1)/ Num time slots), and wherein Vdd is a voltage level representing logic state "1" in an active high logic system and Num time slots is computed in the first computing; and outputting the drive waveform sequence to the LCD pixel multiplexed set.

2. The method of claim 1, wherein the determining comprises accessing a display memory to obtain the desired state of each pixel.

3. The method of claim 1, wherein the deriving comprises:

computing an index from the state of all pixels in the LCD pixel multiplexed set; and retrieving the drive waveform sequence from storage using the index.

4. The method of claim 3, wherein the index is computed by using a binary weighing of the state of all pixels in the LCD pixel multiplexed set.

5. The method of claim 3, wherein the drive waveform sequence is stored in a look-up table.

6. The method of claim 1, wherein the deriving comprises:

computing an index from the state of all pixels in the LCD pixel multiplexed set; and generating the drive waveform sequence from the index.

7. The method of claim 6, wherein the generating is performed by a sequence generator.

8. The method of claim 1, wherein the derived drive waveform sequence is inverted and outputted to the LCD pixel multiplexed set.

9. A method for computing a drive waveform for a liquid crystal display (LCD) pixel multiplexed set, wherein the LCD pixel multiplexed set contains a plurality of pixels, the method comprising:

computing a number of time slots based upon a number of pixels in the plurality of pixels;

generating a set of common waveform sequences;

determining a number of potential drive waveform sequences;

calculating a root-mean squared (RMS) voltage value for each pixel in the LCD pixel multiplexed set for each potential drive waveform sequence and common waveform sequence combination, wherein the desired RMS on voltage and the desired RMS off voltage are computed using expressions Vrmsoff=Vdd* sqrt((Num time slots/2−1/Num time slots) and Vrmson=Vdd* sqrt ((Num time slots/2+1/Num time slots), wherein Vdd is a voltage level representing logic state "1" in an active high logic system and Num time slots is computed in the first computing; and selecting a potential drive waveform sequence for each possible combination of pixel values for the pixels in the LCD pixel multiplexed set.

10. The method of claim 9 further comprising after the determining, computing a desired RMS on voltage and a desired RMS off voltage.

11. The method of claim 9, wherein the number of time slots is computed using an expression: Num_time_slots= (Num_pixels_per_multiplexed_set*2)−2, wherein Num_pixels_per_multiplexed_set is the number of pixels in the multiplexed set.

12. The method of claim 9, wherein the RMS voltage value for an N-th pixel of a potential drive waveform sequence is computed from the potential drive waveform sequence and an N-th common waveform sequence.

13. The method of claim 9, wherein the selecting comprises:

creating a binary table with an entry for each possible combination of pixel values;

populating the binary table with desired RMS on voltages and desired RMS off voltages; and for each possible combination of pixel values, selecting a potential drive waveform sequence with RMS voltage values that are substantially equal to the desired RMS on voltages and the desired RMS off voltages.

14. The method of claim 13, wherein the desired RMS voltage value for a low-value entry is expressible as Vrmsoff=Vdd*sqrt((Num_time_slots/2−1)/Num_time_slots) and the desired RMS voltage value for a high-value entry is expressible as Vrmson=Vdd*sqrt((Num_time_slots/2+1)/Num_time_slots), wherein the low-value entry is represented by logic value "0" and the high-value entry is represented by logic value "1."

15. The method of claim 13, wherein if more than one potential drive waveform sequence has desired RMS voltage values that are substantially equal with the desired RMS on voltage and the desired RMS off voltage, then a potential drive waveform sequence is selected randomly.

16. The method of claim 9, wherein for an LCD with ⅓ multiplexing and common waveform sequences of "0100," "0010," and "0001," the potential drive waveform sequences for each possible combination of pixel values are as follows:

| Pixel value | Sequence |
|---|---|
| 000 | 0000 |
| 001 | 0110 |
| 010 | 0101 |
| 011 | 1100 |
| 100 | 0011 |
| 101 | 1010 |
| 110 | 1001 |
| 111 | 1111. |

17. The method of claim 9, wherein for an LCD with ¼ multiplexing and common waveform sequences of "001000," "000100," "000010," and "000001," the potential drive waveform sequences for each possible combination of pixel values are as follows:

| Pixel value | Sequence |
|---|---|
| 0000 | 010000 |
| 0001 | 001110 |
| 0010 | 001101 |
| 0011 | 011100 |
| 0100 | 001011 |
| 0101 | 011010 |
| 0110 | 011001 |
| 0111 | 111000 |
| 1000 | 000111 |
| 1001 | 010110 |
| 1010 | 010101 |
| 1011 | 110100 |
| 1100 | 010011 |
| 1101 | 110010 |
| 1110 | 110001 |
| 1111 | 011111. |

18. The method of claim 9, wherein for an LCD with ⅕ multiplexing and common waveform sequences of "00010000," "00001000," "00000100," "00000010," and "0000001," the potential drive waveform sequences for each possible combination of pixel values are as follows:

| Pixel value | Sequence |
|---|---|
| 00000 | 01100000 |
| 00001 | 00011110 |
| 00010 | 00011101 |
| 00011 | 00111100 |
| 00100 | 00011011 |
| 00101 | 00111010 |
| 00110 | 00111001 |
| 00111 | 01111000 |
| 01000 | 00010111 |
| 01001 | 00110110 |
| 01010 | 00110101 |
| 01011 | 01110100 |
| 01100 | 00110011 |
| 01101 | 01110010 |
| 01110 | 01110001 |
| 01111 | 11110000 |
| 10000 | 00001111 |
| 10001 | 00101110 |
| 10010 | 00101101 |
| 10011 | 01101100 |
| 10100 | 00101011 |
| 10101 | 01101010 |
| 10110 | 01101001 |
| 10111 | 11101000 |
| 11000 | 00100111 |
| 11001 | 01100110 |
| 11010 | 01100101 |
| 11011 | 11100100 |
| 11100 | 01100011 |
| 11101 | 11100010 |
| 11110 | 11100001 |
| 11111 | 00111111. |

19. A liquid crystal display (LCD) drive circuit for an LCD, wherein the LCD has a multiplex factor of N, the LCD drive circuit comprising:

a processor configured to group data to be displayed on the LCD based upon a value of pixels in a multiplexed set and for calculating a root-mean squared (RMS) voltage value for each pixel in the LCD pixel multiplexed set for each potential drive waveform sequence and common waveform sequence combination, wherein the RMS on voltage and the desired RMS off voltage are computed using expressions Vrmsoff=Vdd*sqrt((Num time slots/2−1)/Num time slots) and Vrmson=Vdd*sqrt((Num time slots/2+1)/Num time slots), and wherein Vdd is a voltage level representing logic state "1" in an active high logic system and Num time slots is computed in the first computing;

a display logic circuit coupled to the processor, the display logic circuit configured to derive a drive waveform based upon the value of pixels in the multiplexed set;

a plurality of select driver circuits coupled to the display logic circuit, each select driver circuit to place a drive waveform sequence onto a select signal line; and a phase generator coupled to the processor, the phase generator configured to continually place N common waveform sequences onto N common signal lines, each common waveform sequence on a unique common signal line.

20. The LCD drive circuit of claim 19, wherein the display logic circuit comprises:

an index circuit coupled to the processor, the index circuit configured to compute an index value based upon the value of pixels provided by the processor; and a memory coupled to the index circuit, the memory to store a series of drive waveform sequences accessible by index values, wherein the memory provides a drive waveform sequence associated with the index value when the index circuit provides the index value.

21. The LCD drive circuit of claim 20, wherein the index circuit computes the index value by applying a binary weighing to a group of N pixel values.

22. The LCD drive circuit of claim 19, wherein there are M segment driver circuits wherein M is expressible as: M=ceiling (Num_pixels/N), wherein ceiling(x) returns a smallest integer greater than or equal to x.

23. The LCD drive circuit of claim 19, wherein the display logic circuit comprises:

an index circuit coupled to the processor, the index circuit configured to compute an index value based upon the value of pixels provided by the processor; and a sequence generator coupled to the index circuit, the sequence generator to dynamically generate the drive waveform sequence based upon the index value provided by the index circuit.

* * * * *